US007717739B2

(12) United States Patent
Hawkins et al.

(10) Patent No.: US 7,717,739 B2
(45) Date of Patent: May 18, 2010

(54) POWER ADAPTER

(75) Inventors: Anthony Hawkins, Upland, CA (US); Dennis Michael McClary, Los Banos, CA (US)

(73) Assignee: SRI International, Menlo Park, CA (US)

( * ) Notice: Subject to any disclaimer, the term of this patent is extended or adjusted under 35 U.S.C. 154(b) by 155 days.

(21) Appl. No.: 11/815,762

(22) PCT Filed: Feb. 7, 2006

(86) PCT No.: PCT/US2006/004194

§ 371 (c)(1),
(2), (4) Date: Aug. 7, 2007

(87) PCT Pub. No.: WO2006/086347

PCT Pub. Date: Aug. 17, 2006

(65) Prior Publication Data

US 2008/0188109 A1 Aug. 7, 2008

Related U.S. Application Data

(60) Provisional application No. 60/650,608, filed on Feb. 7, 2005.

(51) Int. Cl.
*H01R 11/00* (2006.01)

(52) U.S. Cl. ..... 439/503; 439/638; 439/957

(58) Field of Classification Search ..... 439/500, 439/503, 504, 581, 638, 650, 653, 668, 675, 439/709, 957

See application file for complete search history.

(56) References Cited

U.S. PATENT DOCUMENTS

| | | | | | |
|---|---|---|---|---|---|
| 2,579,973 | A * | 12/1951 | Schlosser | 439/519 |
| 3,014,977 | A * | 12/1961 | Geiser | 174/549 |
| 4,248,494 | A * | 2/1981 | McDonald et al. | 439/638 |
| 4,647,139 | A * | 3/1987 | Yang | 439/483 |
| 5,766,020 | A * | 6/1998 | Hughes | 439/35 |
| 6,115,277 | A * | 9/2000 | Plichta et al. | 363/146 |
| 6,160,373 | A | 12/2000 | Dunn et al. | |
| 6,172,892 | B1 | 1/2001 | Plichta et al. | |
| 6,390,824 | B1 * | 5/2002 | Vance | 439/35 |
| 6,559,556 | B1 | 5/2003 | Wills | |
| 7,128,604 | B2 * | 10/2006 | Hall | 439/578 |
| 7,291,017 | B1 * | 11/2007 | Fain et al. | 439/35 |
| 7,364,457 | B2 * | 4/2008 | Mehki | 439/504 |
| 2008/0188109 | A1 * | 8/2008 | Hawkins et al. | 439/287 |

OTHER PUBLICATIONS

PCT Search Report and Written Opinion for PCT/US06/04194; copy consists of 9 unnumbered pages.

* cited by examiner

*Primary Examiner*—James Harvey

(57) ABSTRACT

In one embodiment, the present invention is a power adapter for coupling electrical power from a standard North Atlantic Treaty Organization (NATO) power coupling to one or more electronic devices. In one embodiment, the power adapter includes a plug connector adapted for receiving electrical power from the power coupling, a receptacle adapted for providing the electrical power to a slave cable (e.g., an inter-vehicular slave cable), and at least one terminal adapted for providing the electrical power to the electronic devices (e.g., a computer system). The power adapter is thus capable of maximizing the potential of the power coupling to provide electrical power for multiple simultaneous uses.

15 Claims, 9 Drawing Sheets

POWER ADAPTER

CROSS REFERENCE TO RELATED APPLICATIONS

This application claims the benefit of U.S. Provisional Patent Application Ser. No. 60/650,608, filed Feb. 7, 2005, which is herein incorporated by reference in its entirety.

FIELD OF THE INVENTION

The present invention relates generally to power couplings and relates more particularly to adapters for supplying electrical power from power couplings to other devices.

BACKGROUND OF THE INVENTION

North Atlantic Treaty Organization (NATO) standardization agreement (STANAG) 4074 ("Auxiliary Power Unit Connections for Starting Tactical Land Vehicles") defines the physical and electrical characteristics of a power coupling provisioned on many military vehicles used throughout NATO countries. The purpose of the power coupling is to provide, by use of an inter-vehicular slave cable, means for "jump starting" a second vehicle which has low power and is unable to be started in the usual manner.

Just as cigarette lighters in consumer vehicles have become a popular means for providing power to other electrical devices (e.g., cellular phone chargers), the power coupling on military vehicles is often used to supply electrical power to additional devices that are temporarily installed in the vehicle (e.g., computer systems). Typically only a single power coupling is provided in a vehicle, although several devices may need to be simultaneously powered at any given time. Competition therefore exists between devices for access to the power coupling. Moreover, use of the power coupling to provide electrical power to these devices prevents the power coupling from being available for its primary purpose, namely, jump starting second vehicles.

Thus, there is a need in the art for a power adapter for use with standard NATO power couplings.

SUMMARY OF THE INVENTION

In one embodiment, the present invention is a power adapter for coupling electrical power from a standard North Atlantic Treaty Organization (NATO) power coupling to one or more electronic devices. In one embodiment, the power adapter includes a plug connector adapted for receiving electrical power from the power coupling, a receptacle adapted for providing the electrical power to a slave cable (e.g., an inter-vehicular slave cable), and at least one terminal adapted for providing the electrical power to the electronic devices (e.g., a computer system). The power adapter is thus capable of maximizing the potential of the power coupling to provide electrical power for multiple simultaneous uses.

BRIEF DESCRIPTION OF THE DRAWINGS

The teaching of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the present invention relates to power couplings for standard NATO vehicle power couplings (such as those used in many military vehicles). Embodiments of the invention are configured not only to provide power from the power coupling to additional electronic devices (e.g., computer systems), but also to provide power to an inter-vehicular slave cable. Thus, the potential of the power coupling is maximized without impeding its use for its primary purpose.

Figure 1A:
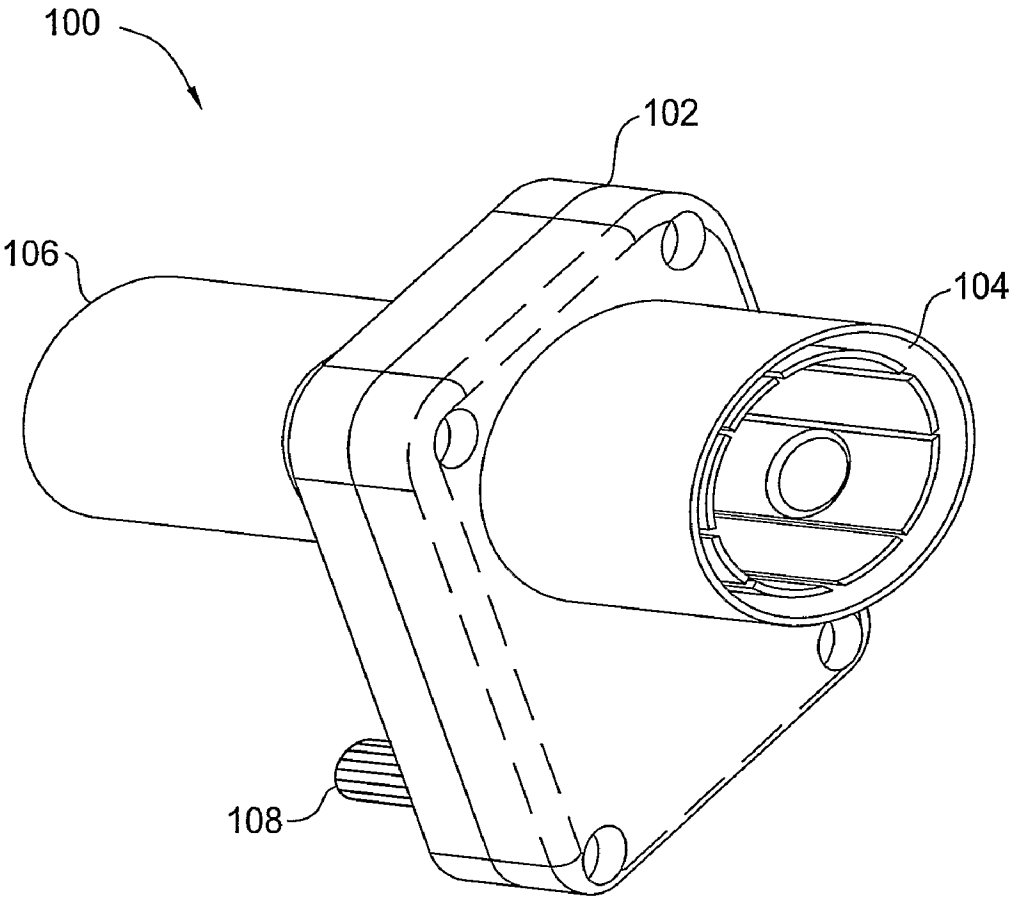
FIG. 1A illustrates a perspective view of one embodiment of a power adapter, according to the present invention.
Figure 1B:
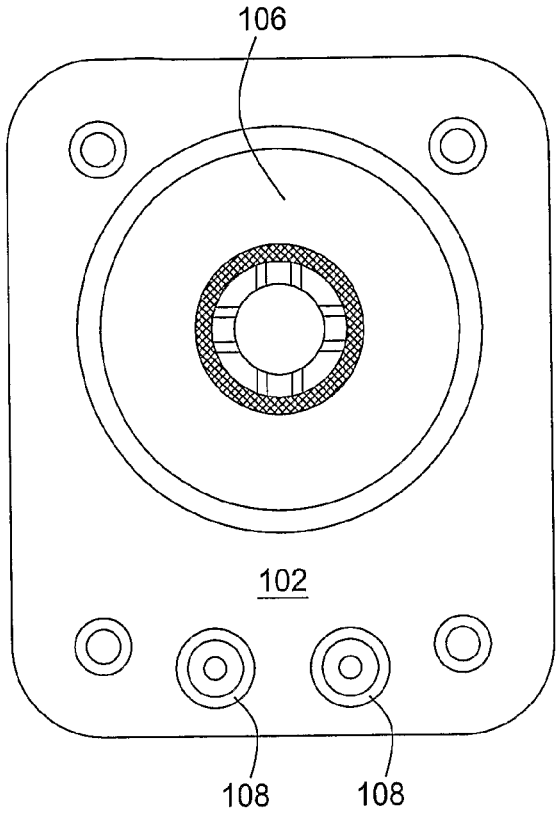
FIGS. 1B and 1C illustrate planar views of a first side and a second side of the power adapter of FIG. 1A, respectively.
Figure 1C:
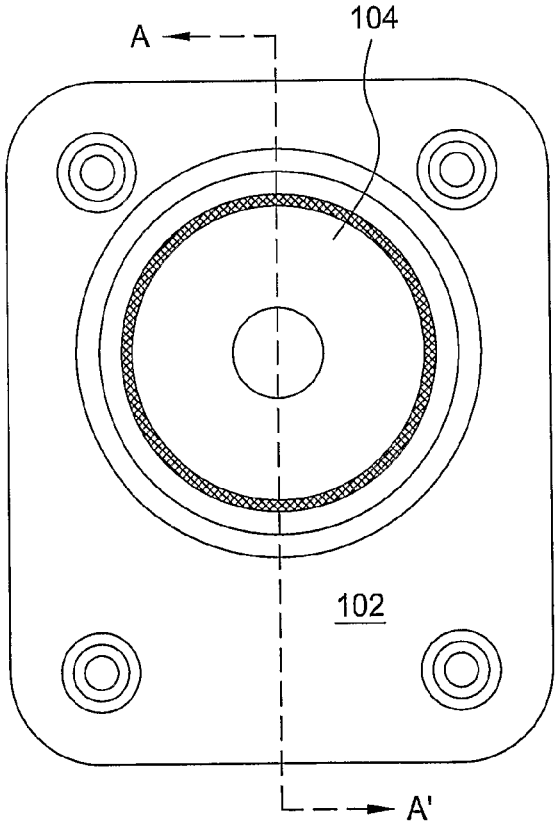

FIG. 1A illustrates a perspective view of one embodiment of a power adapter 100, according to the present invention. FIGS. 1B and 1C illustrate planar views of a first side and a second side of the power adapter 100 of FIG. 1A, respectively. The power adapter 100 is configured for insertion in a standard NATO power coupling (e.g., as used in a military vehicle) and comprises a non-electrically conducting housing 102 for containing a plurality of coupling components (described in greater detail with respect to FIG. 2) that facilitate the coupling of power from the power coupling to an electronic device (e.g., a computer system). The exterior of the housing 102 includes a plug connector 104, a receptacle 106 and at least one terminal 108.

The plug connector 104 is coupled to the housing 102 and is adapted to mate with a receptacle connector (not shown) of the standard NATO power coupling to receive electrical power therefrom. That is, the plug connector 104 is where the power adapter 100 "plugs in" to the power coupling. The receptacle 106 is also coupled to the housing 102 and is adapted to mate with a plug connector of an inter-vehicular slave cable (not shown, e.g., for jump starting a second vehicle) to provide electrical power thereto. Thus, the receptacle 106 is where the slave cable plugs in to the power adapter 100. Accordingly, the receptacle 106 is configured in a manner substantially similar to a typical receptacle connector for a standard NATO power coupling, such as a receptacle connector with which the plug connector 104 can mate. Each terminal 108 is coupled to the housing 102 and is adapted to supply electrical power to an electronic device coupled thereto (not shown). To this end, each terminal comprises an electrical connection connected to an exterior binding post.

In this manner, the power adapter 100 is configured not only to provide power from the power coupling to additional electronic devices (e.g., computer systems, via terminals 108), but also to provide power to an inter-vehicular slave cable (via the receptacle 106). Thus, the potential of the power coupling is maximized without impeding its use for its primary purpose. Moreover, multiple power adapters conforming to the design of the power adapter 100 may be used simultaneously by inserting their respective plug connectors 104 into their neighboring power adapter's receptacles 106.

Moreover, although the power adapter 100 has been described within the context of a type 1 NATO power coupling, the power adapter 100 may also be easily adapted for use with type 2 NATO power couplings by utilizing a known converter device that adapts type 2 NATO power couplings for use by type 1 NATO power coupling connectors.

Figure 2:
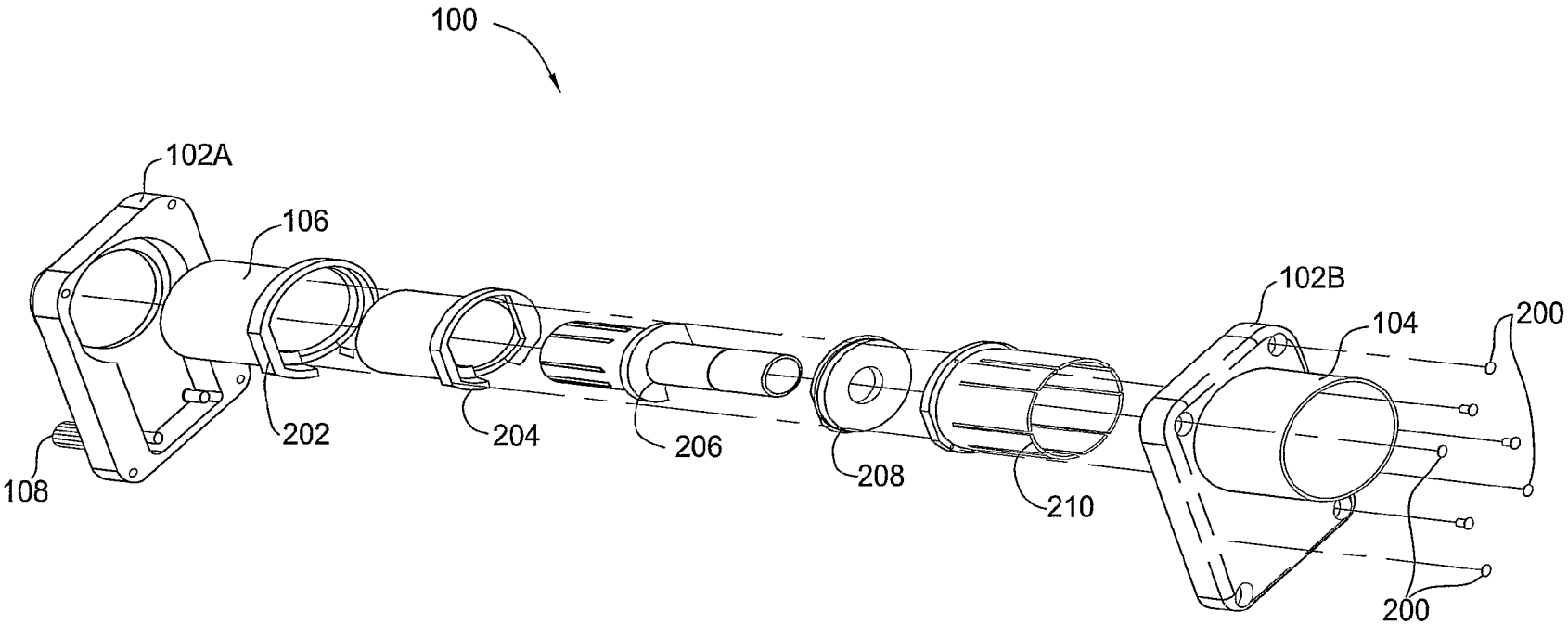
FIG. 2 illustrates an exploded view of the power adapter of FIGS. 1A-1C.
Figure 3:
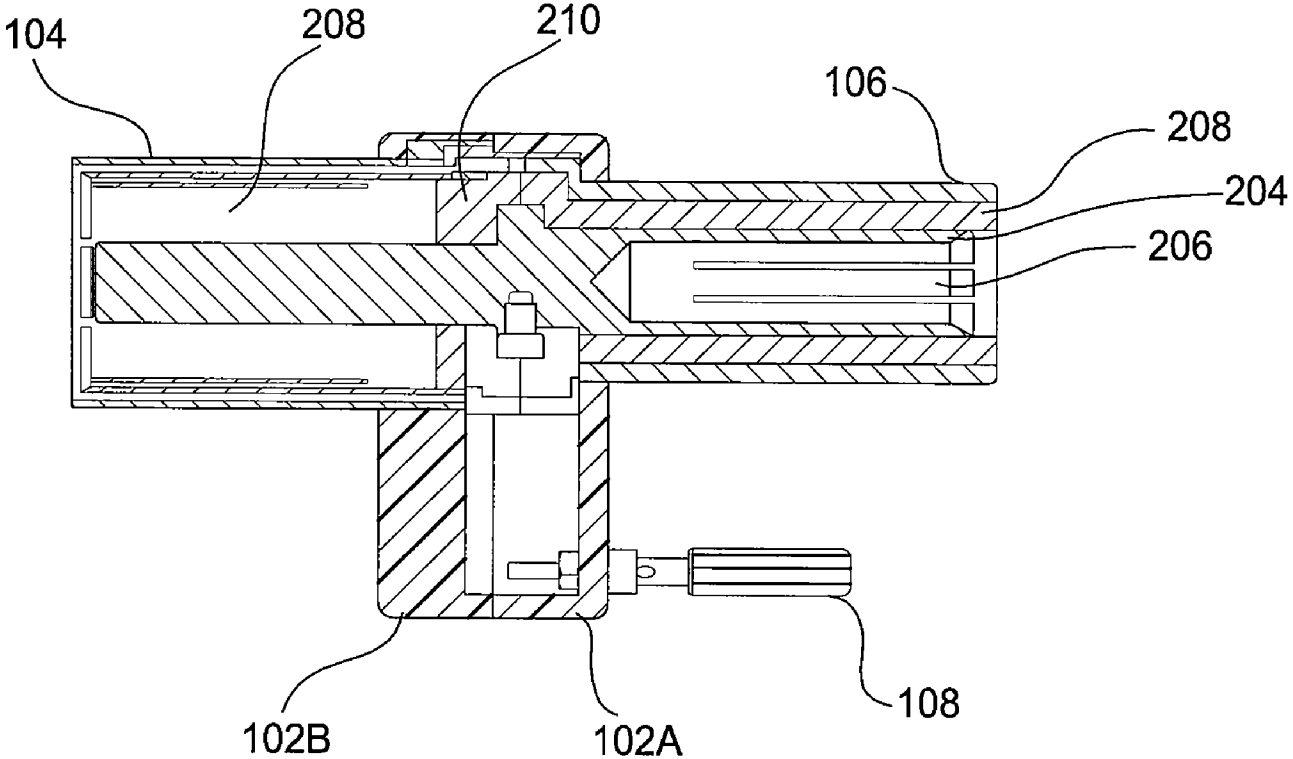
FIG. 3 illustrates a cross-sectional view of the power adapter.

FIG. 2 illustrates an exploded view of the power adapter 100 of FIGS. 1A-1C, and FIG. 3 illustrates a cross-sectional view of the power adapter 100 (i.e., taken along line A-A' of FIG. 1C). As illustrated, the housing 102 is split into first and second pieces 102*a*, 102*b* that are joined by a plurality of fasteners (e.g., screws) 200. The coupling components that are contained within the housing are further illustrated as well, including a negative female 202, a dielectric female 204, a center pin 206, a dielectric male 208 and a negative male 210. These coupling components form the plug connector 104 and receptacle 106.

Figure 4A:
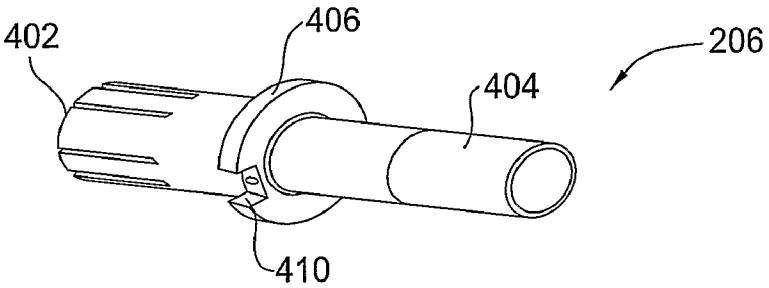
FIGS. 4A, 4B and 4C illustrate, respectively, perspective, cross-sectional and planar views of one embodiment of the center pin.
Figure 4C:
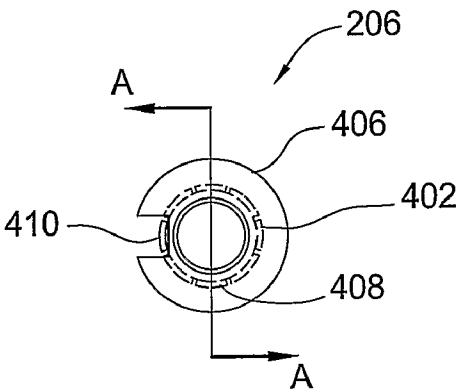
Figure 4B:
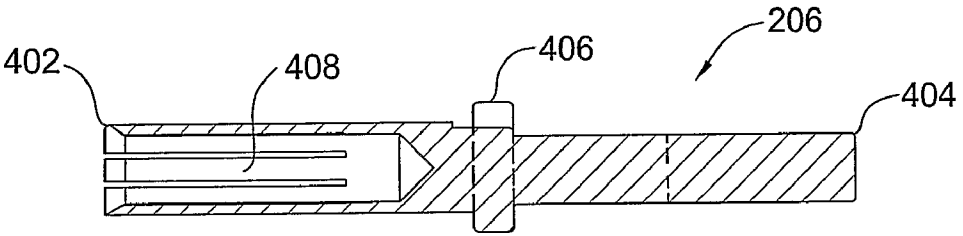

FIGS. 4A, 4B and 4C illustrate, respectively, perspective, cross-sectional (i.e., taken along line A-A' of FIG. 4C) and planar views of one embodiment of the center pin 206. In one embodiment, the center pin 206 is constructed from one or more materials that comply with NATO standard STANAG 4074 §4e and has a substantially elongated shape having a first end 402, a second end 404 and an enlarged middle section 406. In one embodiment, each of the first end 402, second end 404 and middle section 406 has a different diameter, with the diameter of the middle section 406 being the greatest. The middle section 406 further comprises a cut-away section 410. The first end 402 of the center pin 206 further comprises a screw tap 408 for attaching (e.g., via mediating circuitry in some embodiments) wiring to electrically connect the center pin 206 to a terminal 108 of the power adapter 100.

Figure 5A:
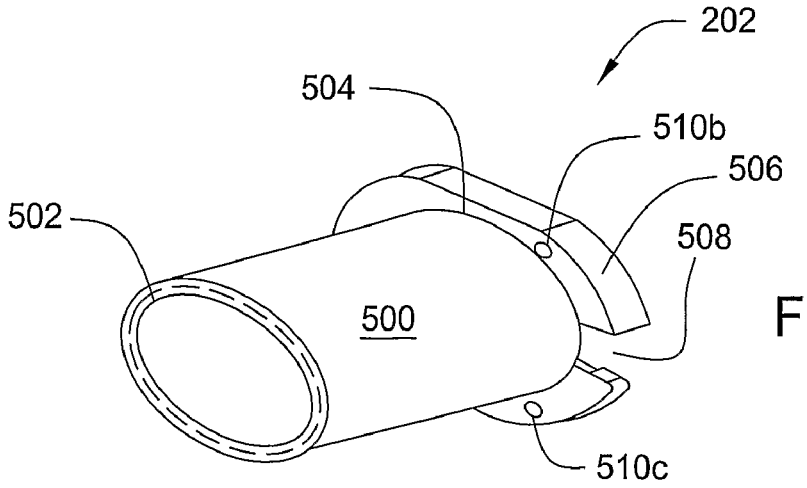
FIGS. 5A, 5B and 5C illustrate, respectively, perspective, cross-sectional and planar views of one embodiment of the negative female.
Figure 5B:
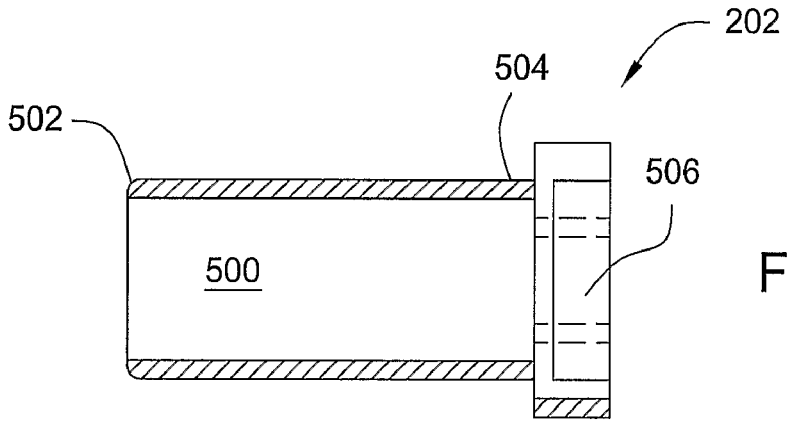
Figure 5C:
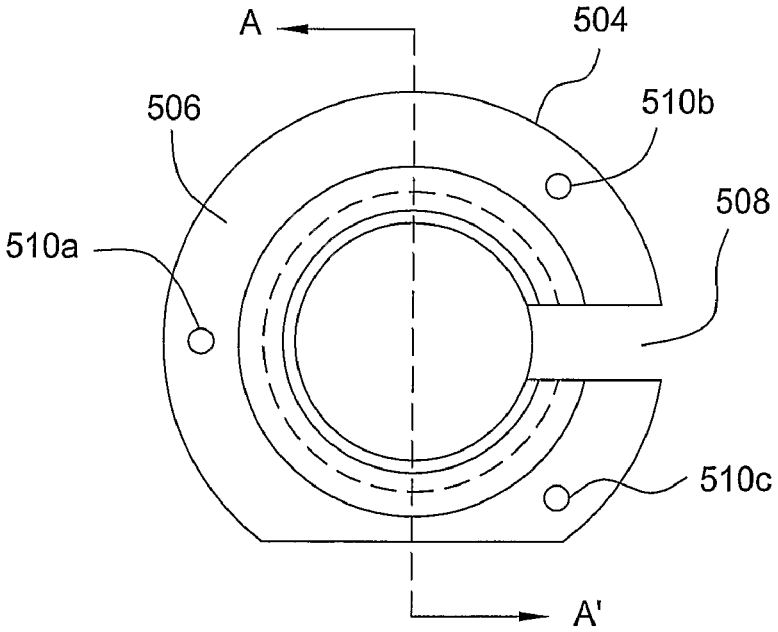

FIGS. 5A, 5B and 5C illustrate, respectively, perspective, cross-sectional (i.e., taken along line A-A' of FIG. 5C) and planar views of one embodiment of the negative female 202. In one embodiment, the negative female 202 is constructed from one or more materials that comply with NATO standard STANAG 4074 §4e and has a hollow, substantially cylindrical body 500 having a first end 502 and a second end 504. The second end 504 further comprises a lip 506 that extends around at least a portion of the circumference of the second end 504, except for a cut-away portion 508 that allows for routing of wiring (not show) to the negative male 210. The lip 506 further comprises one or more screw taps 510*a*-510*c* (hereinafter collectively referred to as "screw taps 510") for further facilitating mating of the negative female 202 with the negative male 210 (i.e., via one or more fasteners inserted therein).

Figure 6A:
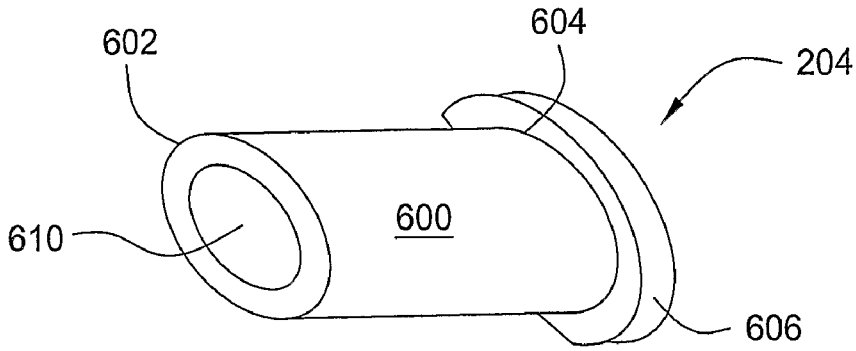
FIGS. 6A, 6B and 6C illustrate, respectively, perspective, cross-sectional and planar views of one embodiment of the dielectric female.
Figure 6B:
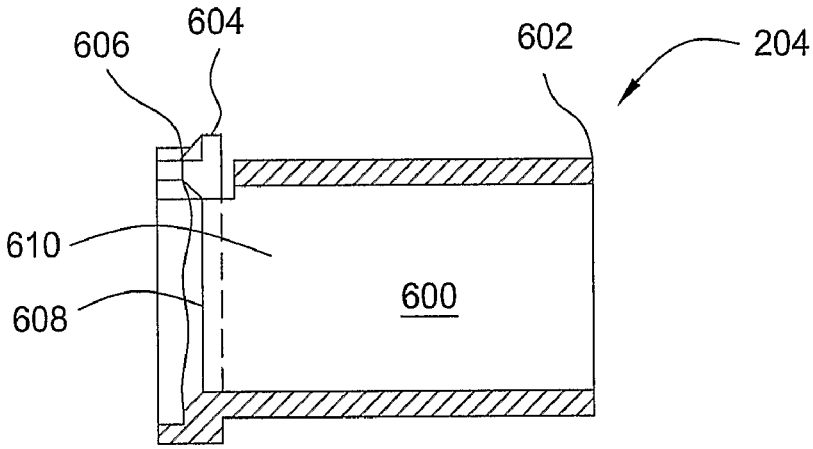
Figure 6C:
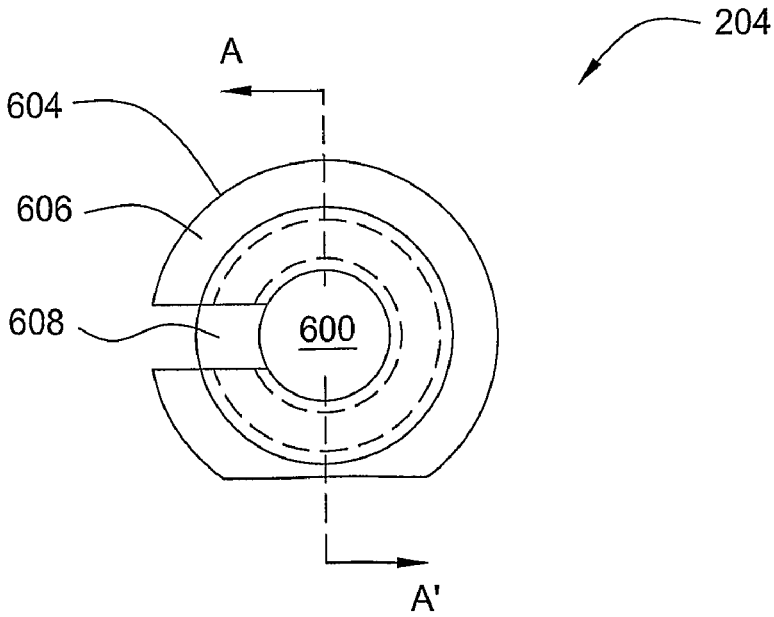

FIGS. 6A, 6B and 6C illustrate, respectively, perspective, cross-sectional (i.e., taken along line A-A' of FIG. 6C) and planar views of one embodiment of the dielectric female 204. The dielectric female 204 is shaped in a manner substantially similar to the negative female 202 and has a hollow, substantially cylindrical body 600 having a first end 602 and a second end 604. The second end 604 further comprises a lip 606 that extends around at least a portion of the circumference of the second end 604, except for a cut-away portion 608 that allows for routing of wiring (not show) to the center pin 206. In addition, dielectric female 204 comprises a hollow cavity 610 for mating with the middle section 406 of the center pin 206, as discussed in further detail below. The mating of the cavity 610 with the middle section 406 of the center pin 206 substantially prevents rotation of the center pin 206 when the power adapter 100 is assembled. The dielectric female 204 is formed of an electrically non-conductive material.

Figure 7A:
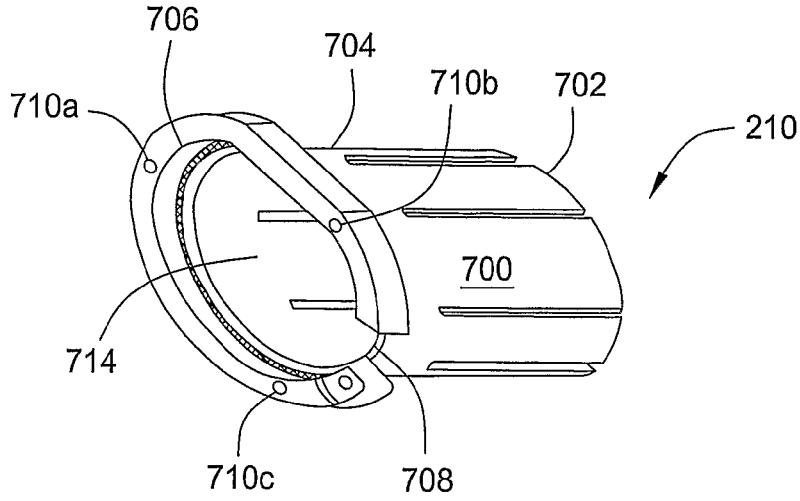
FIGS. 7A, 7B and 7C illustrate, respectively, perspective, cross-sectional and planar views of one embodiment of the negative male.
Figure 7B:
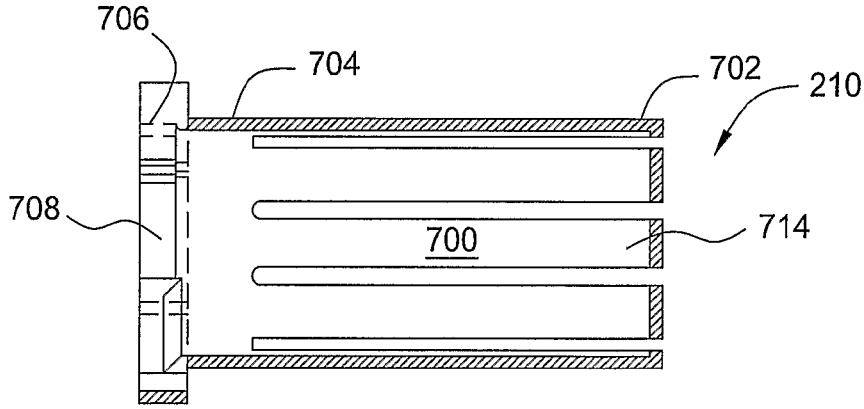
Figure 7C:
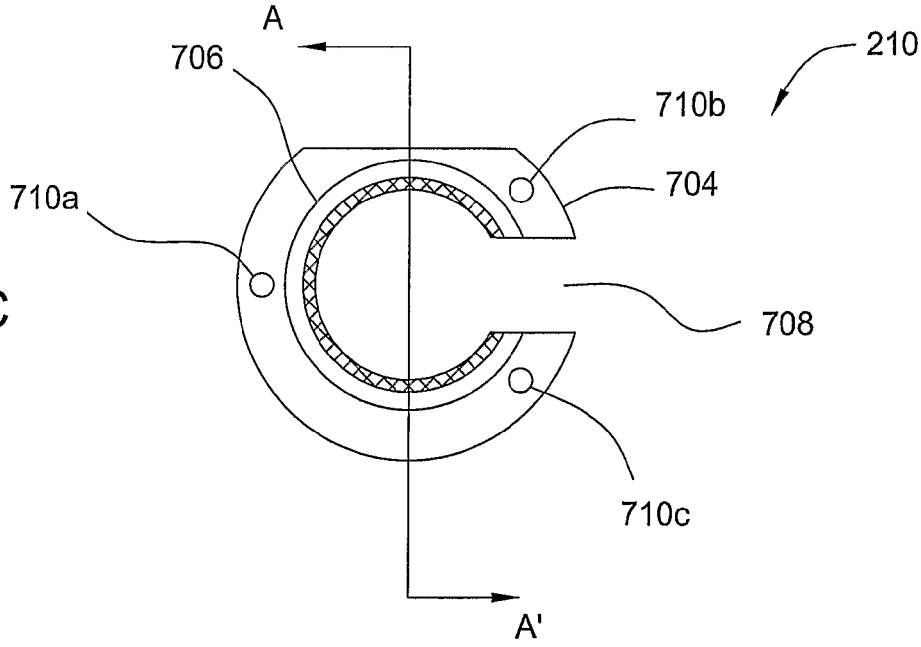

FIGS. 7A, 7B and 7C illustrate, respectively, perspective, cross-sectional (i.e., taken along line A-A' of FIG. 74C) and planar views of one embodiment of the negative male 210. In one embodiment, the negative male 210 is constructed from one or more materials that comply with NATO standard STANAG 4074 §4e and is shaped in a manner substantially similar to the negative female 202. Thus, the negative male 210 has a hollow, substantially cylindrical body 700 having a first end 702 and a second end 704. A first screw tap 714 allows for the attachment of wiring (not shown) that electrically connects (e.g., via mediating circuitry in some embodiments) the negative male 210 to a terminal 108 of the power adapter 100. The second end 704 further comprises a lip 706 that extends around at least a portion of the circumference of the second end 704, except for a cut-away portion 708 that allows for routing of wiring (not shown) to a terminal 108 of the power adapter 100. In addition, the lip 706 further comprises one or more additional screw taps 710*a*-710*c* (hereinafter collectively referred to as "screw taps 710") for further facilitating mating of the negative female 202 with the negative male 210 (i.e., via one or more fasteners inserted therein).

Figure 8A:
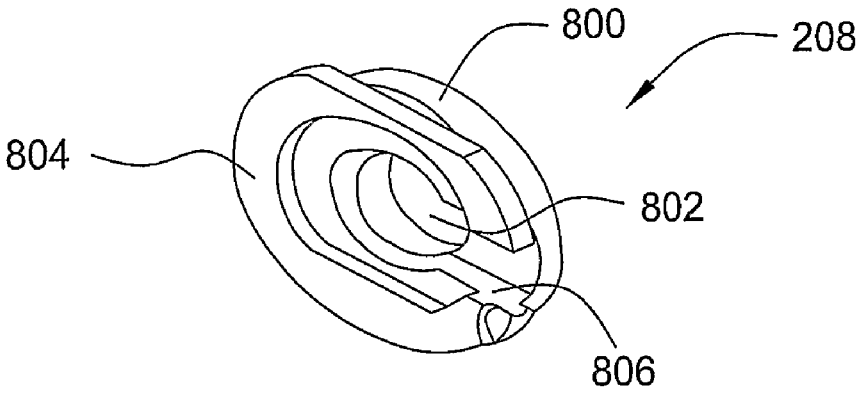
FIGS. 8A, 8B and 8C illustrate, respectively, perspective, cross-sectional and planar views of one embodiment of the dielectric male.
Figure 8B:
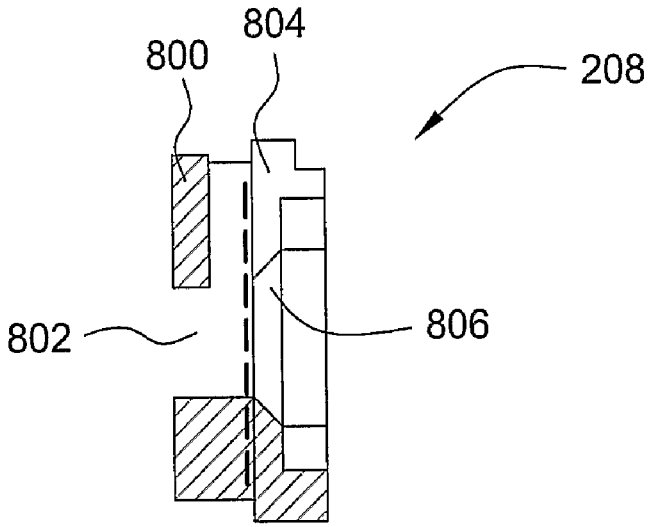
Figure 8C:
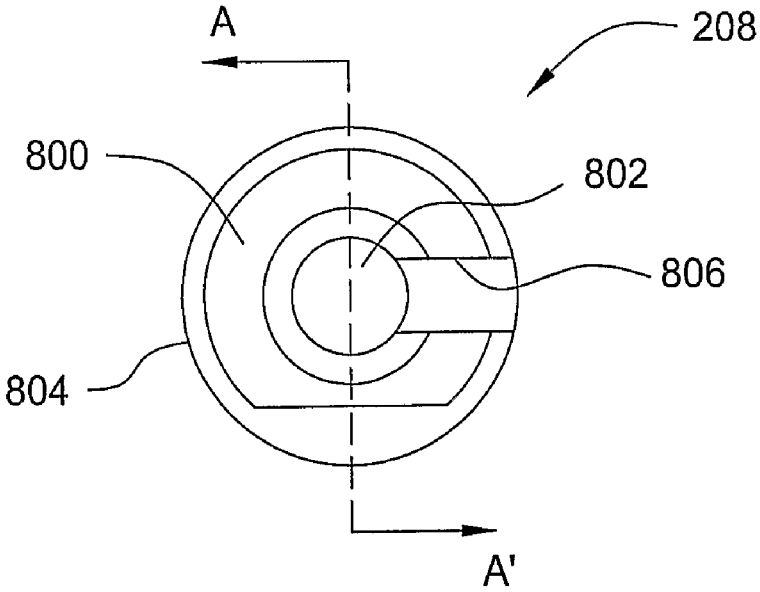

FIGS. 8A, 8B and 8C illustrate, respectively, perspective, cross-sectional (i.e., taken along line A-A' of FIG. 8C) and planar views of one embodiment of the dielectric male 208. The dielectric male 208 is shaped in a manner substantially similar a washer and has a substantially elliptical body 800 having an aperture 802 formed substantially centrally therein. The body 800 further comprises a lip 804 that extends around at least a portion of the circumference of the body 800, except for a cut-away portion 806 that allows for routing of wiring (not shown) to the negative male 210. The dielectric male 208 is formed of an electrically non-conductive material.

Referring back to FIG. 2, the assembly of the coupling components will be discussed in greater detail. As illustrated, center pin 206 is adapted to connect the positive terminal of the plug connector 104 to the positive terminal of the receptacle 106, while the negative female 202 and the negative male 210 are adapted, when physically mated (e.g., via fasteners disposed through the screw taps 510 and 710), to connect the negative terminal of the plug connector 104 to the negative terminal of the receptacle 106. Thus, the center pin 206 comprises the innermost component of the power adapter 100 and is "nested" within the physically mated negative female 202 and negative male 210, where both the negative female 202 and the negative male 210.

The dielectric female 204 is positioned between the center pin 206 and the negative female 202 (e.g., such that the center pin 206 is nested within the dielectric female 204, which is nested within the negative female 202) in order to insulate the negative female 202 from the center pin 206. Specifically, as discussed above, the cavity 610 of the dielectric female 204 mates with the middle section 406 of the center pin 206 to substantially prevent rotation of the center pin 206 when the power adapter 100 is assembled.

The dielectric male 208 is positioned between the center pin 206 and the negative male 210 (e.g., such that the second end 404 of the center pin 206 protrudes through the aperture 802 in the dielectric male 208, which is nested within the negative male 210) in order to insulate the negative male 210 from the center pin 206.

In one embodiment, electrical connections (not shown) between the coupling components and the terminals 108 of the power adapter are made by connecting a first terminal 108 (e.g., by wire of a suitable gauge to pass the required current) to the center pin 206. A second terminal 108 is then connected in a similar fashion to the negative male 210. In further embodiments, these electrical connections are mediated by circuitry (e.g., a fuse, a circuit breaker, a surge protector, a switch, a light-emitting diode or other visual indicator of live terminals, or a transformer for providing alternate output voltages). In one embodiment, mediating circuitry is rated such that when the power adapter 100 is connected to a vehicle power coupling and to an inter-vehicular slave cable, any equipment connected to a terminal 108 of the power adapter 100 is protected from the use of the slave cable to jump start a second vehicle.

In further embodiments still, the power adapter 100 comprises multiple pairs 108 of terminals. In one embodiment, different terminal pairs utilize the same mediating circuitry. In another embodiment, different terminal pairs utilize different mediating circuitry. For example, each terminal pair may provide a different voltage, have an independent fuse or circuit breaker, be controlled by a different switch, or have an independent visual indicator.

Thus, the present invention represents a significant advancement in the field of power couplings. Embodiments of the invention are configured not only to provide power from a standard NATO vehicle power coupling to additional electronic devices (e.g. computer systems), but also to provide power to an inter-vehicular slave cable. Thus, the potential of the power coupling is maximized without impeding its use for its primary purpose.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus for coupling electrical power from a standard North Atlantic Treaty Organization (NATO) power coupling to one or more electronic devices, the apparatus comprising:

a plug connector adapted for receiving said electrical power from said NATO power coupling;

a receptacle adapted for providing said electrical power to a slave cable;

at least one terminal adapted for providing said electrical power to said one or more electronic devices;

a center pin connecting a positive terminal of said plug connector to a positive terminal of said receptacle;

a negative male; and a negative female mated with said negative male such that a mated pair comprising said negative female and said negative male connects a negative terminal of said plug connector to a negative terminal of said receptacle.

2. The apparatus of claim 1, wherein said NATO power coupling is of a type used in military vehicles.

3. The apparatus of claim 1, wherein said NATO power coupling is of the type defined by NATO standardization agreement 4074.

4. The apparatus of claim 1, wherein said at least one terminal comprises an electrical connection connected to a binding post.

5. The apparatus of claim 1, wherein said center pin is nested within said mated pair.

6. The apparatus of claim 1, wherein at least one of: said center pin, said negative male, or said negative female is constructed from one or more materials that comply with NATO standardization agreement 4074 as of Feb. 7, 2006.

7. The apparatus of claim 1, wherein said center pin connects said positive terminal of said plug connector to said positive terminal of said receptacle with assistance from mediating circuitry.

8. The apparatus of claim 7, wherein said mediating circuitry comprises at least one of: a fuse, a circuit breaker, a surge protector, a switch, a light-emitting diode, or a transformer.

9. The apparatus of claim 7, wherein said mediating circuitry is rated such that connection of said one or more electrical devices to said at least one terminal is protected from connection of said slave cable to said plug connector.

10. The apparatus of claim 7, wherein said at least one terminal comprises at least two pairs of terminals, said mediating circuitry being shared by said at least two pairs of terminals.

11. The apparatus of claim 7, wherein said at least one terminal comprises at least two pairs of terminals, each of said at least two pairs of terminals utilizing different mediating circuitry.

12. The apparatus of claim 1, wherein said mated pair connects said negative terminal of said plug connector to said negative terminal of said receptacle with assistance from mediating circuitry.

13. The apparatus of claim 12, wherein said mediating circuitry comprises at least one of: a fuse, a circuit breaker, a surge protector, a switch, a light-emitting diode, or a transformer.

14. The apparatus of claim 1, further comprising:

a dielectric male positioned between said center pin and said negative male; and a dielectric female positioned between said center pin and said negative female.

15. The apparatus of claim 14, wherein said dielectric male and said dielectric female are each formed of an electrically non-conducting material.

* * * * *